US005503390A

United States Patent [19]

Hall

[11] Patent Number: 5,503,390

[45] Date of Patent: Apr. 2, 1996

[54] ADJUSTABLE BASKETBALL BACKBOARD SUPPORT SYSTEM

[76] Inventor: Timothy D. Hall, 1220 Park Ave. #1, Piqua, Ohio 45356

[21] Appl. No.: 888,652

[22] Filed: May 27, 1992

Related U.S. Application Data

[62] Division of Ser. No. 672,595, Mar. 19, 1991, Pat. No. 343,883.

[51] Int. Cl.[6] ..... A63B 63/08

[52] U.S. Cl. ..... 273/1.5 R; 248/291.1

[58] Field of Search ..... 273/1.5 R, 1.5 A; 248/280.1, 292.1, 281.1

[56] References Cited

U.S. PATENT DOCUMENTS

| | | | |
|---|---|---|---|
| 278,797 | 6/1883 | Ide | 248/292.1 |
| 316,548 | 4/1885 | How | 248/280.1 |
| 344,652 | 6/1886 | Hammerstein | 248/292.1 |
| 1,504,166 | 8/1924 | Thornley | 273/1.5 R |
| 2,313,188 | 3/1943 | Woodburn | 273/1.5 R |
| 2,881,003 | 4/1959 | Drew | 273/1.5 R |
| 2,986,395 | 5/1961 | Sheftel | 273/1.5 R |
| 3,427,025 | 2/1969 | Procter | 273/1.5 R |
| 3,586,324 | 6/1971 | Bearson | 273/1.5 R |
| 3,669,450 | 6/1972 | Mason | 273/1.5 R |
| 3,722,886 | 3/1973 | Sinner | 273/1.5 R |
| 3,765,676 | 10/1973 | Bearson et al. | 273/1.5 R |
| 4,330,101 | 5/1982 | Andersen | 273/1.5 R |
| 4,395,040 | 7/1983 | White | 273/1.5 R |
| 4,465,277 | 8/1984 | Dittrich | 273/1.5 A |
| 4,702,450 | 10/1987 | Barisa | 248/292.1 |
| 4,781,375 | 11/1988 | Nye | 273/1.5 R |
| 4,798,381 | 1/1989 | Dadbeh | 273/1.5 R |
| 4,801,142 | 1/1989 | Friesen | 273/1.5 R |
| 4,941,661 | 7/1990 | Lykens | 273/1.5 R |
| 4,951,944 | 8/1990 | Morgan | 273/1.5 R |
| 5,133,547 | 7/1992 | Pardi | 273/1.5 R |

FOREIGN PATENT DOCUMENTS

| | | | |
|---|---|---|---|
| 681631 | 10/1966 | Belgium | 273/1.5 R |
| 286213 | 2/1965 | Netherlands | 273/1.5 R |
| 6413102 | 5/1966 | Netherlands | 273/1.5 R |
| 908055 | 10/1962 | United Kingdom | 273/1.5 R |

OTHER PUBLICATIONS

Basketball Survey Center, Easy–Adjuster Adjustable Basketball Pole Owners Manual, 1–1989.

*Primary Examiner*—Paul E. Shapiro
*Attorney, Agent, or Firm*—Barnes & Thornburg

[57] ABSTRACT

An adjustable basketball goal that can be raised and lowered easily, quickly, and safely. The simplicity of this design is made possible by the use of a counterweight, parallel links and pins.

2 Claims, 2 Drawing Sheets

ADJUSTABLE BASKETBALL BACKBOARD SUPPORT SYSTEM

A divisional of application Ser. No. 672,595 filed Mar. 19, 1991, now U.S. Pat. No. DES 343,883 issued Feb. 1, 1994.

SUMMARY OF THE INVENTION

An adjustable basketball goal that can be raised and lowered with ease by the use of a counterweight and parallelogram structure. The parallelogram structure consists of upper and lower links pinned to the support post. These links are pinned toward the top of the support post. Both links extend to the front of the support post and also extend to the back. The links extend frontwardly where they are pinned to a backboard support bracket. The links extend rearwardly where top links have a counterweight pinned at the end. The lower links extend rearwardly where they are pinned at the end, to the top of a more vertical set of links. The lower end of the more vertical set of links is pinned through the post at one of the holes drilled through the post, located behind a plate wider than the post that is welded to the front of the post.

The desired height of the goal is achieved by removing a cotter key and a pin from the lower end of the more vertical links. By removing this pin, the lower end of the links are free from the post. Then raise or lower the links until holes in the bottom end of links align with hole in post that places goal at the desired position. Insert pin through these holes and insert cotter key to prevent pin from coming out.

This operation is done with ease because the counterweight makes raising and lowering the more vertical links effortless and little strength is needed. The pin and cotter key combination allows for fast adjustments.

ADVANTAGES

The advantages of this invention are as follows: The only time you have to get wrenches out is to fasten the backboard to the backboard bracket.

Assembly is quick by simply inserting pins and cotter keys. The counterweight allows for no heavy lifting. Thus, kids can raise and lower the goal safely without asking for help.

DESCRIPTION

Figure 1:
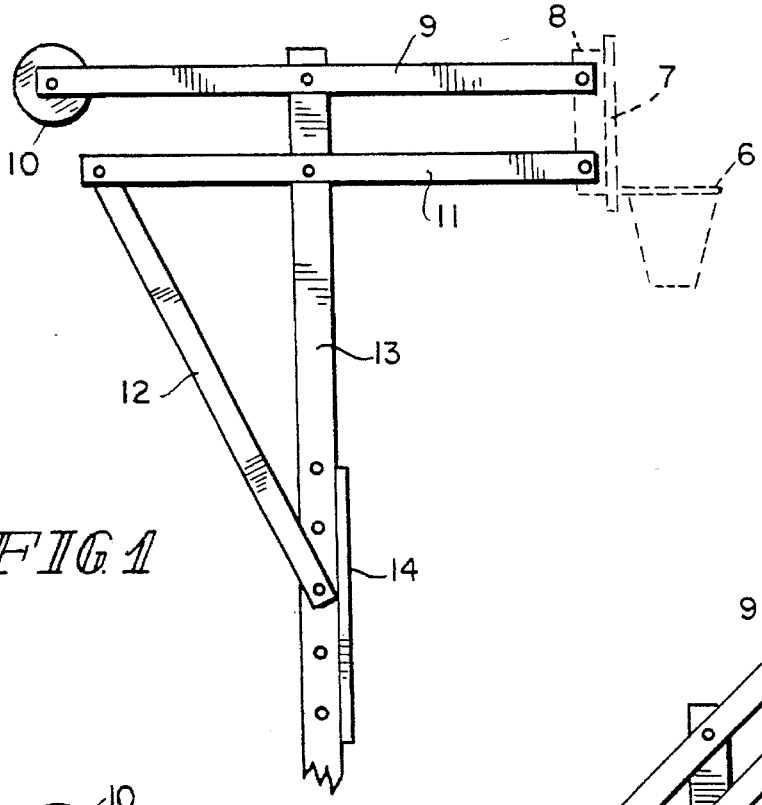
FIG. 1 illustrates a side view of the adjustable basketball goal set at eight feet.

In FIG. 1, the adjustable basketball goal is shown at the eight-foot position. The goal 6 is attached to the backboard 7. The backboard 7 and goal 6 together are fastened to a backboard bracket 8, consisting of two angle pieces. The backboard bracket 8 is pinned to the front of an upper set of parallel support links 9 and to the front of a lower set of parallel support links 11.

The upper set of parallel links 9 is pinned at the center, close to the top of the hollow support post 13.

The lower set of parallel links 11 is pinned closer to the rear, below the upper links 11 to the hollow support post 13.

The upper support links 9 have a counterweight 10 pinned at the rear. This counterweight 10 will balance out the weight of the goal 6, backboard 7 and backboard bracket 8.

At the rear end of the lower support links 11, a more vertical set of adjustment links 12 is pinned. The lower end of the adjustment links is pinned through the support post 13.

A front plate 14 is welded to the front of the support post 13. This front plate 14 is wider than the support post 13 to prevent the lower end of the adjustment links 12 from extending forward.

Raising or lowering is done by removing a pin and raising or lowering the lower end of the adjustment links 12.

The raising and lowering is done with ease because of the counterweight 10.

Figure 2:
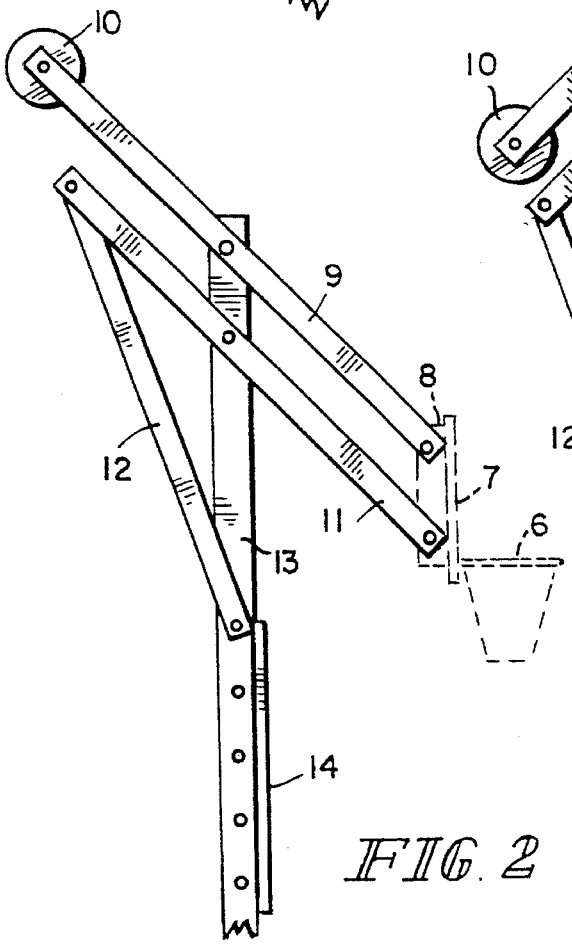
FIG. 2 illustrates a side view of the adjustable basketball goal set at six feet.

In FIG. 2, the adjustable basketball goal is shown at the six foot position.

By removing a pin from lower end of the height adjust links 12, and raising this end, the goal 6 is lowered.

Figure 3:
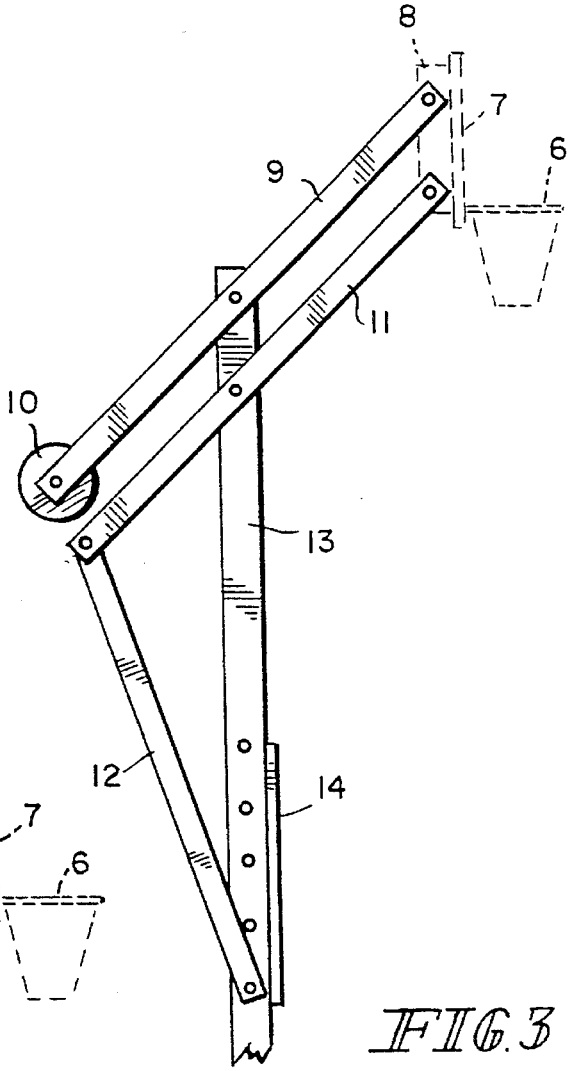
FIG. 3 illustrates a side view of the adjustable basketball goal set at ten feet, standard height.

In FIG. 3, the basketball goal is shown at the ten-foot position.

By removing a pin from the lower end of the height adjust links 12 and lowering this end, the goal 6 is raised.

Figure 4:
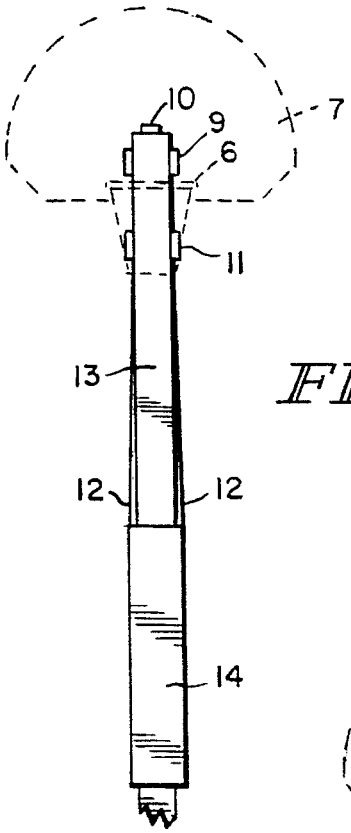
FIG. 4 illustrates a front view of the adjustable basketball goal set at a position lower than ten feet.

In FIG. 4, the adjustable basketball goal is shown in a front view in a lowered position. The front plate 14 is shown to be wider than the support post 13 to prevent height adjust links 12 from extending frontwardly past the support post 13.

Figure 5:
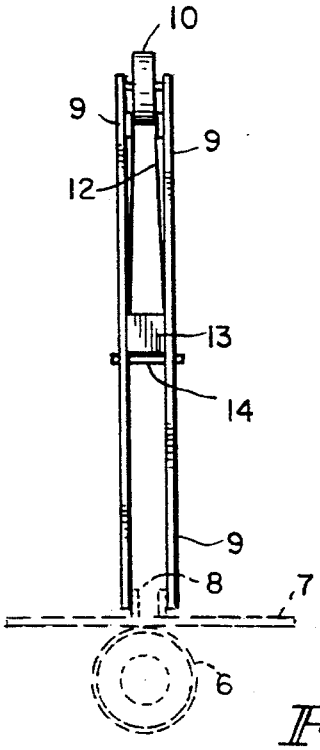
FIG. 5 illustrates a top view of the adjustable basketball goal showing the support post, counterweight, top set of links.

In FIG. 5, a top view of the adjustable basketball goal is shown.

Figure 6:
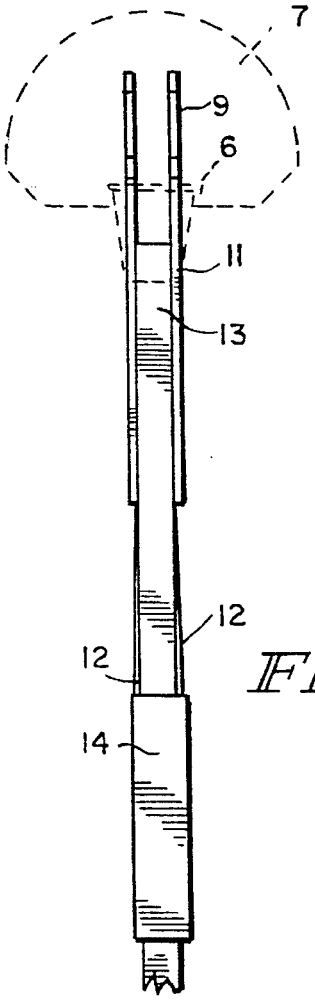
FIG. 6 illustrates a front view of the adjustable basketball goal set at a position higher than FIG. 4.

In FIG. 6, a front view of the adjustable basketball goal is shown in a raised position.

What is claimed:

1. An adjustable basketball backboard support system comprising:

a basketball backboard;

a support member;

a parallelogram linkage system, including at least two parallel links pivotally connected to the basketball backboard and the support member, to cantileverly support the basketball backboard spaced from and at varying heights with respect to the support member;

at least one of said at least two parallel links extending past said support member;

a counter-weight means, including a mass attached to an extension of one of said at least two parallel links, for applying a force to said parallelogram linkage system in opposition to a force applied to the two links by the weight of the basketball backboard; and adjustment means adjustably connecting an extension of one of said at least two parallel links to said support member for determining the height of the basketball backboard.

2. The adjustable backboard of claim 1 wherein said mass and said adjustment means are connected to extensions of different ones of said at least two parallel links.

* * * * *